US005881623A

United States Patent [19]

Otani et al.

[11] Patent Number: 5,881,623

[45] Date of Patent: Mar. 16, 1999

[54] CUTTING CARRIAGE FOR SHEET CUTTING AND SHEET CUTTER USING SAME

[75] Inventors: Hitoshi Otani, Yasugi; Junichi Nakao, Yonago, both of Japan

[73] Assignees: Hitachi Metals, Ltd., Tokyo; HMY, Ltd., Shimane-ken, both of Japan

[21] Appl. No.: 798,301

[22] Filed: Feb. 7, 1997

[30] Foreign Application Priority Data

Mar. 19, 1996 [JP] Japan ..... 8-062272

[51] Int. Cl.[6] ..... B26D 1/18

[52] U.S. Cl. ..... 83/455; 83/488; 83/578; 83/614

[58] Field of Search ..... 83/487, 488, 489, 83/501, 578, 614, 455

[56] References Cited

U.S. PATENT DOCUMENTS

| | | | |
|---|---|---|---|
| 1,418,104 | 5/1922 | Spiselman | 83/488 X |
| 3,137,192 | 6/1964 | McNeill | 83/614 X |
| 4,448,101 | 5/1984 | Templeton | 83/489 X |
| 4,535,664 | 8/1985 | Raymond | 83/614 X |
| 4,922,778 | 5/1990 | Nagai | 83/501 |
| 5,042,349 | 8/1991 | Komatsu | 83/488 X |
| 5,440,961 | 8/1995 | Lucas, Jr. et al. | 83/489 X |
| 5,503,053 | 4/1996 | Onishi et al. | 83/488 |

FOREIGN PATENT DOCUMENTS

| | | |
|---|---|---|
| 50-24466 | 8/1975 | Japan . |
| 58-37594 | 8/1983 | Japan . |
| 1-149286 | 10/1989 | Japan . |
| 2-250793 | 10/1990 | Japan . |
| 3-88688 | 9/1991 | Japan . |
| 4-128195 | 11/1992 | Japan . |
| 5-177585 | 7/1993 | Japan . |
| 7-24782 | 1/1995 | Japan . |
| 7-52085 | 2/1995 | Japan . |
| 7-124892 | 5/1995 | Japan . |
| 8-57797 | 3/1996 | Japan . |
| 2038225 | 7/1980 | United Kingdom . |
| 2070496 | 9/1981 | United Kingdom . |
| 2299778 | 10/1996 | United Kingdom . |

*Primary Examiner*—Eugenia A. Jones
*Attorney, Agent, or Firm*—Finnegan, Henderson, Farabow, Garrett & Dunner

[57] ABSTRACT

There is disclosed a construction in which the shaking of a cutting carriage due to a clearance is prevented, thereby enhancing cutting precision. The cutting carriage includes at least one rotary blade for cutting a sheet, and a pair of opposed driven rotary members held respectively against obverse and reverse surfaces of a guide track member, said pair of driven rotary members being rotated in accordance with the movement of the cutting carriage along said guide track member. The cutting carriage for sheet cutting can include a pair of rotary blades which are forcibly rotated respectively by the pair of driven rotary members when these driven rotary members are rotated. Preferably, the pair of rotary blades are held in press-contact with each other at a toe-in angle. A sheet cutter of the invention includes the guide track member having a flat plate portion extending in a direction of a cutting width, and the carriage guided by this guide track member, and a moving device, such as a screw and a wire, for moving the cutting carriage. Preferably, the obverse surface of the flat plate portion serves as a surface for supporting the sheet thereon, and also serves as a travel surface for one of the pair of driven rotary members. The sheet is held between the flat plate portion and the one driven rotary member during the movement of the cutting carriage.

8 Claims, 3 Drawing Sheets

CUTTING CARRIAGE FOR SHEET CUTTING AND SHEET CUTTER USING SAME

BACKGROUND OF THE INVENTION

1. Field of the Invention

This invention relates to a cutting carriage for sheet cutting used in a copier, a facsimile machine, a printer or the like, and also relates to a sheet cutter using such a carriage.

2. Related Art

One example of conventional sheet cutters, mounted on a recording apparatus such as a copier, a printer and a facsimile machine, is a so-called rotary-type cutter as disclosed in Japanese Patent Examined Publication No. 50-24466, in which two blades, having a width corresponding to a cutting width, are provided, and one of the two blades is rotated, and is brought into press-contact with the other blade in intersecting relation thereto, thereby cutting a sheet.

Another conventional sheet cutter is a so-called Guillotine-type sheet cutter as disclosed in Japanese Utility Model Examined Publication No. 58-37594, in which two blades, having a width corresponding to a cutting width, are provided, and one of the two blades is moved vertically (upward and downward), and is brought into sliding contact with the other blade, thereby cutting a sheet.

These cutters have an advantage that the sheet can be cut rapidly since there are used the two blades having the width corresponding to the cutting width.

These cutters have an advantage that the cutting speed is high since there are used the two blades having the width corresponding to the cutting width. However, the blades are large in size, and therefore there has been encountered a problem that a load required for driving the blade is large.

Under the circumstances, there has been proposed a sheet cutter of the blade moving-type as disclosed in Japanese Utility Model Unexamined Publication Nos. 4-128195 and 3-88688, in which a circular blade or a knife edge blade is moved in sliding contact with a stationary blade, having a substantially straight cutting edge extending in a direction of a cutting width of a sheet, thereby cutting the sheet.

In this sheet cutter of the blade moving-type, the blade itself is moved, and the size of the moving blade is not limited by the cutting width, and can be small, and therefore there is an advantage that a load, required for driving the blade, is smaller as compared with the load required in the above rotary-type and Guillotine-type cutters. Therefore, the sheet cutter of the blade moving-type is advantageous in that the sheet cutter itself can be formed into a small size.

Japanese Patent Unexamined Publication Nos. 7-52085, 7-24782, 5-177585, 2-250793 and 8-57797 and Japanese Utility Model Unexamined Publication No. 1-149286 disclose a sheet cutter of the blade moving-type in which instead of using a stationary blade, a pair of circular blades are combined together in press-contact with each other, and the pair of circular blades are moved in a cutting direction, thereby cutting a sheet by the press-contacted portions of the two circular blades.

In this sheet cutter of the blade-moving type, there is no need to provide a stationary blade having a length corresponding to the cutting width, and therefore this construction is advantageous in that the size of the sheet cutter can be further reduced.

The above sheet cutter of the blade moving-type can be of a smaller size, and therefore it is advantageous to incorporate this type of sheet cutter in an office automation machine, such as a copier, a facsimile machine and a printer, which is required to have a space-saving design.

In such a blade-moving type sheet cutter, regardless of whether it is the type of sheet cutter using a stationary blade or the type of sheet cutter having a pair of rotary blades movable in a cutting direction, there is needed a carriage which supports the blade, and is movable in a cutting direction.

In connection with a blade moving-type sheet cutter using a stationary blade, Japanese Patent Unexamined Publication No. 7-124892 discloses a carriage having a bearing mechanism rotatably supporting a circular blade (rotary blade).

This publication also discloses a carriage in which a roller is provided coaxially with the rotary blade, and the roller is brought into contact with the stationary blade to thereby forcibly rotate the rotary blade.

The inventor of the present invention has studied these cutting carriages incorporating the rotary blade, and has found a problem that positional accuracy or precision is lowered by a clearance between a guide rail (guide track member) and the carriage during the cutting operation.

More specifically, because of a very small gap or clearance, a defective cut portion is produced, and the blade deviates from a straight line along which the cutting is to be effected, thereby lowering the accuracy or precision.

SUMMARY OF THE INVENTION

With the above problems in view, it is an object of this invention to provide a cutting carriage for sheet cutting which reduces defective cutting due to a clearance of the carriage, and can effect straight cutting more positively.

Another object of the invention is to provide a sheet cutter suited for such a carriage.

The inventor of the present invention has studied a construction which prevents the lowering of cutting precision due to a clearance between a carriage and a guide track member.

The invention made by the inventor is not directed to the type of carriage having no member rotated in contact with a guide track member as in a conventional construction, or not directed to the type of carriage having a driven rotary member (e.g. roller) held in contact with one side of a guide track member for rotating a rotary blade. The inventor has found that the cutting precision can be greatly enhanced by a construction in which a pair of opposed driven rotary members are held respectively against obverse and reverse surfaces of a guide track member, and the pair of driven rotary members are rotated in accordance with the movement of a carriage along the guide track member.

According to one aspect of the present invention, there is provided a cutting carriage for sheet cutting adapted to be guided by a guide track member extending in a direction of a cutting width, the carriage comprising:

at least one rotary blade for cutting a sheet; and a pair of opposed driven rotary members held respectively against obverse and reverse surfaces of the guide track member, the pair of driven rotary members being rotated in accordance with the movement of the carriage along the guide track member.

Preferably, the rotary blade is rotated by the rotation of one of the two driven rotary members.

Preferably, the rotary blade is connected to the one driven rotary member coaxially therewith.

Preferably, there are provided a pair of the rotary blades which are held in press-contact with each other at a toe-in angle, and the pair of rotary blades are connected coaxially to the pair of driven rotary members, respectively, and the pair of rotary blades are rotated respectively by the pair of driven rotary members when the pair of driven rotary members are rotated.

According to another aspect of the invention, there is provided a sheet cutter comprising:

a guide track member having a flat surface portion extending in a direction of a cutting width;

a carriage comprising (i) at least one rotary blade for cutting a sheet; and (ii) a pair of opposed driven rotary members held respectively against obverse and reverse surfaces of the guide track member, the pair of driven rotary members being rotated in accordance with the movement of the carriage along the guide track member; and moving means for moving the carriage.

Preferably, the obverse surface of the guide track member serves as a surface for supporting the sheet thereon, and also serves as a travel surface for one of the pair of driven rotary members, and the sheet is held between the flat surface portion of the guide track member and the one driven rotary member during the movement of the carriage.

Preferably, the moving means is provided on the reverse side of the guide track member.

DESCRIPTION OF THE PREFERRED EMBODIMENTS

One of the most important features of the present invention is that a pair of opposed driven rotary members are held respectively against obverse and reverse surfaces of a guide track member, the pair of driven rotary members being moved in accordance with the movement of a carriage along the guide track member.

The guide track member is thus held between the pair of driven rotary members, and therefore the carriage can be guided or moved along the guide track member without shaking.

The pair of driven rotary members are pressed against the guide track member so that they respectively receive reaction forces resulting from this press-contact. Because of a balance effect, an unnecessary force does not act on the carriage, so that the carriage can move with a small friction loss.

The driven rotary members are rotated in accordance with the movement of the carriage, and therefore the movement of the carriage is less retarded as compared with a conventional construction in which a driven member is guided only through sliding contact, and as a result the carriage can be smoothly moved.

Preferably, the driven rotary member comprises an O-ring or a roller which is made of an elastic material such as rubber. In order to positively guide the carriage, the driven rotary member is pressed against the guide track to be elastically deformed at a portion thereof corresponding to not less than 10 degrees of the circumference.

A rotary blade may be provided independently of the driven rotary member supported on the carriage.

However, in either of the case where a stationary blade, extending in a direction of the cutting width, and the rotary blade are pressed into sliding contact with each other so as to cut the sheet and the case where a pair of rotary blades, mounted on the carriage, are moved so as to cut the sheet by a point of press-contact between the pair of rotary blades, it is preferred that the rotary blade be forcibly rotated so as to draw in the sheet in accordance with the movement of the carriage.

To achieve this, as shown in FIG. 1, the type of carriage having the pair of movable rotary blades can have a construction in which rotary blades 3*a* and 3*b* are provided coaxially with driven rotary members 2*a* and 2*b*, respectively, and the rotary blades 3*a* and 3*b* are forcibly rotated respectively by the driven rotary members 2*a* and 2*b* when the driven rotary members 2*a* and 2*b* are rotated.

In FIG. 1, a guide rail (guide track member) 6 is held between the pair of driven rotary members 2*a* and 2*b*, and the guide rail 6 has a flat top plate portion 5 for supporting the sheet thereon.

Figure 2:
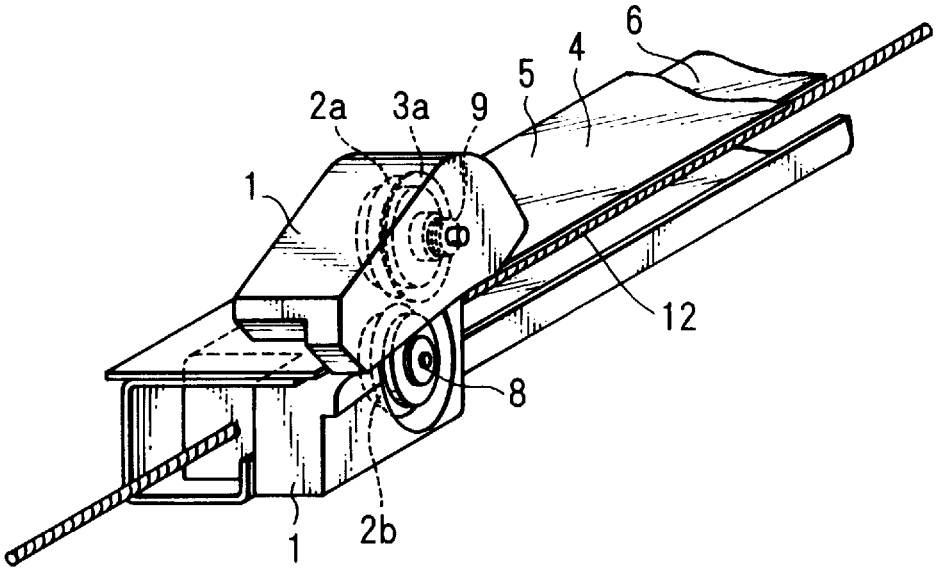
FIG. 2 is a view showing a cutting carriage for sheet cutting according to another embodiment of the invention.

In the case where a stationary blade, extending in a direction of the cutting width, and a rotary blade, mounted on a carriage, are pressed into sliding contact with each other so as to cut a sheet, the rotary blade 3*a* can be provided coaxially with the driven rotary member 2*a* so that the rotary blade 3*a* can be forcibly rotated by the rotation of the driven rotary member 2*a*, as shown in FIG. 2.

In this case, with respect to the pair of driven rotary members constituting the basic elements of the present invention, the driven rotary member 2*b* can be provided on the reverse surface of the guide rail 6 in opposed relation to the driven rotary member 2*a*.

In the sheet cutter shown in FIG. 2, the stationary blade 4 is fixedly secured to the upper surface of the guide rail 6. The guide rail 6 can be of such a construction that it serves also as a stationary blade 4.

As shown in FIGS. 1 and 2, the rotary blade is provided coaxially with the associated driven rotary member, and with this arrangement the rotary blade is guided directly by the guide track member, so that the accuracy of the position of the rotary blade can be enhanced.

In a preferred construction of the invention, a pair of rotary blades are provided as shown in FIG. 1. In a construction using a stationary blade as shown in FIG. 2, an angular movement is applied to the carriage by a cutting reaction force for a rotary blade provided on one side of the guide track, so that the movement of the carriage is retarded. On the other hand, in the construction using the pair of rotary blades, the cutting reaction forces cancel each other by the pair of rotary blades, so that the carriage can move smoothly, which is desirable.

In the construction in which the pair of rotary blades are used, and are forcibly rotated, there is another advantage that the pair of rotary blades positively draw in the sheet when cutting the sheet.

Figure 3:
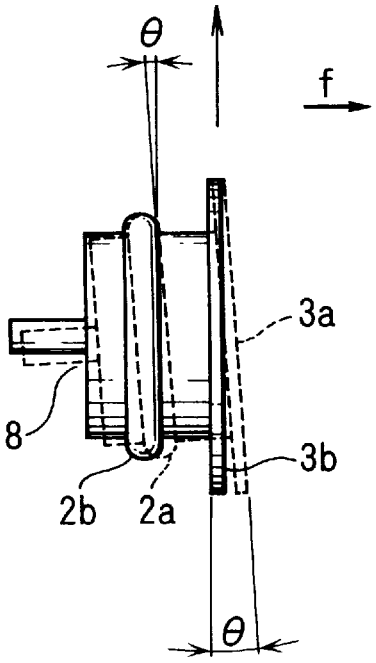
FIG. 3 is a view showing the relation between driven rotary members and rotary blades in the cutting carriage for sheet cutting.

FIG. 3 shows one example of an arrangement of the rotary blades and the driven rotary members which are supported on the carriage body 1 shown in FIG. 1.

In FIG. 3, the rotary blade 3*b* and the driven rotary member 2*b*, which are provided on the reverse side of the guide rail 6, are indicated by solid lines, and the driven rotary member 2*b* is disposed parallel to the direction of travel of the carriage indicated by an arrow. The rotary blade 3*a* and the driven rotary member 2*a*, provided on the obverse side of the guide rail 6, are indicated by broken lines.

As shown in FIG. 3, the rotary blade 3*a* is arranged at a toe-in angle θ, so that the two rotary blades 3*a* and 3*b* are in contact with each other substantially at one point. With this arrangement, a press-contact force, resisting the cutting reaction forces, is easily obtained.

In the present invention, the preferred toe-in angle θ is 0.2 to 3.0 degrees.

In the example shown in FIG. 3, the axis of rotation of the driven rotary member 2*a* (for holding the sheet) on the obverse side of the guide rail 6 is inclined at an angle 6, so that the driven rotary member 2*a* is also arranged at a toe-in angle θ.

Namely, one of the two driven rotary members is inclined at the toe-in angle θ, and the sheet is held between this inclined driven rotary member and the guide track member (guide rail).

With this construction, a force, acting in a direction indicated by arrow f in FIG. 3, can be imparted to the sheet held by the driven rotary member 2*a*. This force f acts in the direction of discharge of the sheet, so that a tension is applied to the sheet, thereby enhancing the cutting precision.

In this case, preferably, a supply side of the sheet is positively held against movement by feed rollers (not shown) or the like.

Preferably, the pair of driven rotary members 2*a* and 2*b* have different outer diameters, respectively, so that the pair of rotary blades can rotate at different peripheral speeds, respectively.

With the use of the two rotary blades rotating at the respective different peripheral speeds, the effect of stroking the paper sheet is enhanced, so that the cutting of the paper sheet can be carried out smoothly.

It is possible to provide a sheet cutter incorporating the above carriage.

More specifically, preferably, as shown in FIGS. 1 and 2, the sheet cutter comprises the guide rail (guide track member) 6, extending in the direction of the cutting width, the above carriage, and moving means for moving the carriage in the cutting direction.

In this case, the obverse side or surface of the flat plate portion 5 of the guide track member 6 serves as a surface for supporting the sheet thereon, and also serves as a travel surface for one driven rotary member 2*a*. As a result of movement of the carriage, the sheet is held between the flat plate portion 5 and the driven rotary member 2*a*, and is prevented from being displaced during the cutting operation, thereby preventing the cutting precision from being lowered.

In a case where the sheet cutter is of such a construction as the sheet is not guided through a gap between constituent members of the sheet cutter, but can be freely set or placed directly on the guide track member as shown in FIG. 1, the time and labor, required for guiding the sheet into position when exchanging the sheet, are reduced, and this is desirable. In this case, in order that the moving means will not interfere with the sheet, it is preferred that the moving means be provided on the reverse side of the guide track member.

Specific examples of the moving means include a screw 10 (FIG. 1), a wire 12 (FIG. 2) pulled under tension in the cutting direction, and a gear.

EXAMPLE

A preferred embodiment of the present invention will now be described in detail with reference to the drawings.

Figure 1A:
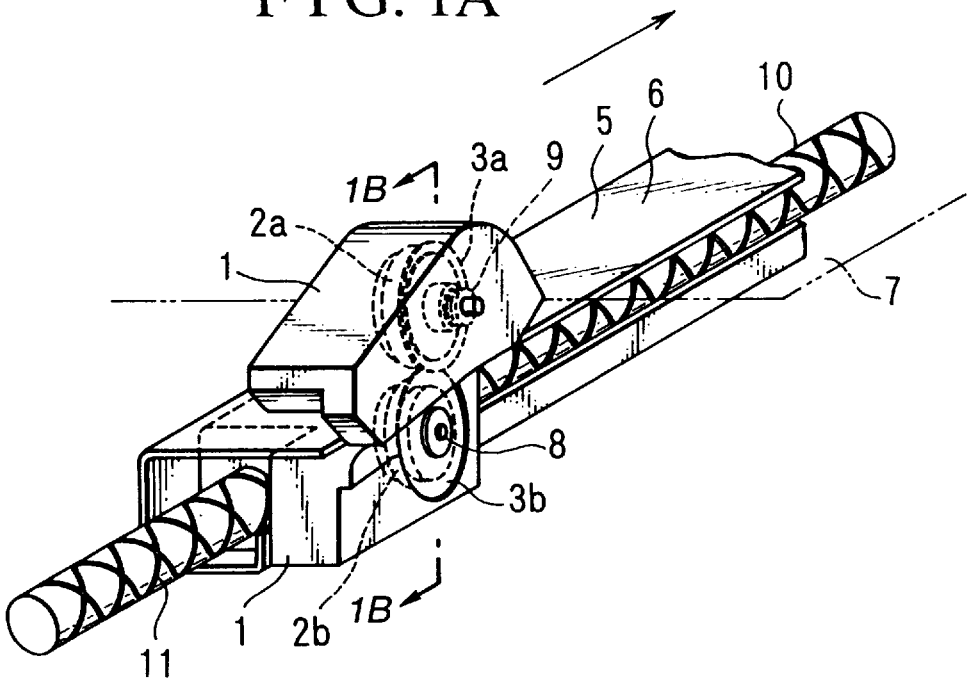
FIG. 1A is a view showing a cutting carriage for sheet cutting according to one preferred embodiment of the present invention.
Figure 1B:
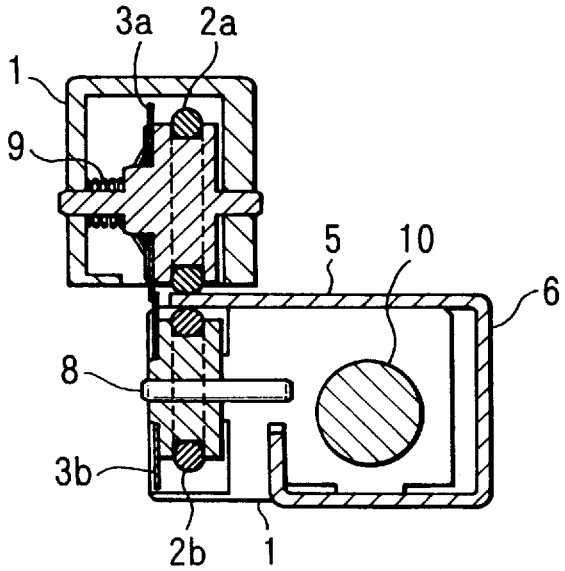
FIG. 1B is a sectional view taken along line A—A in FIG. 1A.
Figure 4:
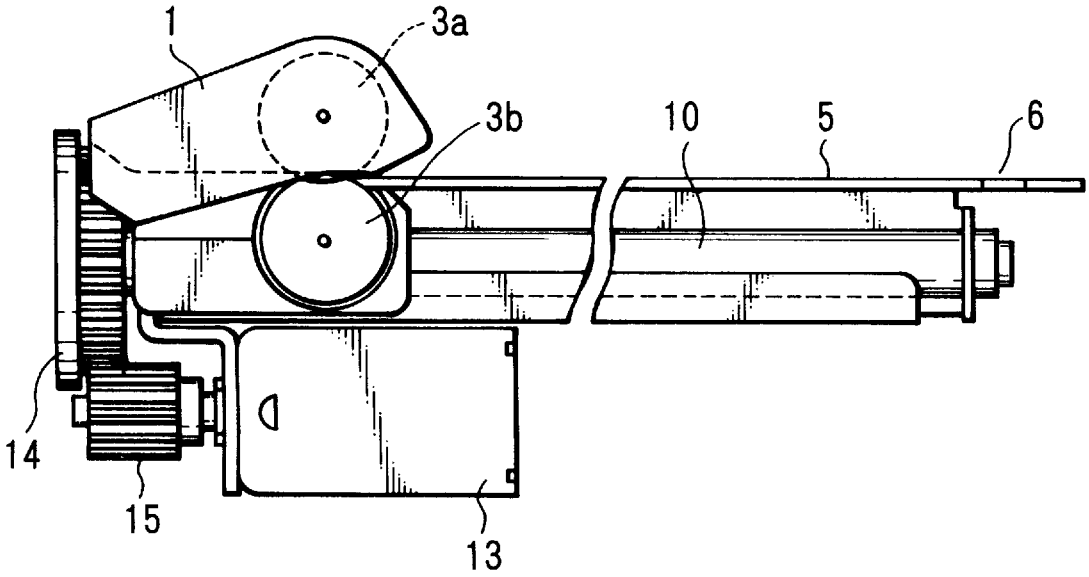
FIG. 4 is a view showing the sheet cutter of the present invention.

FIG. 1 is a view showing a carriage portion of a sheet cutter incorporating a carriage of the present invention, and FIG. 1A shows the appearance, and FIG. 1B is a cross-sectional view taken along the line A—A of FIG. 1A. FIG. 4 shows an overall construction of the sheet cutter.

The cutting carriage for sheet cutting embodying the invention shown in FIG. 1 is of the type in which a pair of rotary blades are moved. A driven rotary member 2*a*, comprising an O-ring of rubber having an outer diameter 12 mm, and a driven rotary member 2*b*, comprising an O-ring of rubber having an outer diameter of 10 mm, are provided on a carriage body 1. The rotary blades 3*a* and 3*b* are connected coaxially to the driven rotary members 2*a* and 2*b*, respectively, and when the driven rotary members 2*a* and 2*b* are rotated, the rotary blades 3*a* and 3*b* are forcibly rotated at different numbers of revolutions, and hence at different peripheral speeds, respectively.

A press-contact spring 9 is connected to the rotary blade 3*a* to hold this rotary blade 3*a* in press-contact with the rotary blade 3*b*.

The two driven rotary members 2*a* and 2*b* are held respectively against opposite sides (i.e., obverse and reverse surfaces) of a flat top plate portion 5 of a guide rail (guide track member) 6 of a generally channel-shaped cross-section having a plate thickness t of 0.8 mm. Thus, the flat top plate portion 5 is held between the two driven rotary members 2*a* and 2*b*. When a screw 10 is rotated, the carriage body 1 is moved in a cutting direction indicated by arrow in FIG. 1. As a result, the two driven rotary members 2*a* and 2*b* are rotated, so that the two rotary blades 3*a* and 3*b* are forcibly rotated so as to draw a sheet 7. At this time, each of the O-rings (driven rotary members) 2*a* and 2*b* is pressed against the flat top plate portion 5 to be elastically deformed at a portion thereof corresponding to about 30 degrees of their circumference.

Although not shown in the drawings, a guide member is mounted on the carriage body 1, and is slidably fitted in a groove 11 in the screw 10. The screw 10 is rotated by a drive mechanism comprising a motor 13 and gears 14 and 15, as shown in FIG. 4.

Since the screw 10, serving as moving means, is provided at the reverse side of the guide rail 6 as shown in FIG. 4, the screw 10 will not interfere with the sheet 7, and the sheet 7 can be freely set on the flat top plate portion 5.

As shown in FIG. 3, the driven rotary member 2*a*, held in contact with the obverse surface of the flat top plate portion 5 of the guide rail 6, is inclined at an angle θ of 1 degree with respect to the direction of cutting of the sheet 7. Thus, the driven rotary member 2*a* is arranged at a toe-in angle of 1 degree, and the driven rotary member 2*a* produces a force f tending to draw out the sheet 7.

The other driven rotary member 2*b* is arranged substantially parallel to the direction of movement of the carriage body 1, as shown in FIG. 3.

The sheet cutter shown in FIG. 4 was incorporated in a facsimile machine, and a cutting test for rolled thermosensitive paper of A4 size was conducted. The pitch of the groove 11 in the screw 10 was 7 mm, and the number of revolutions of the screw 10 was 5,000 rpm.

The cutting test was carried out 10,000 times, and it has been confirmed that deviation of the actual cut line from the intended straight cut line was kept to not more than 0.2 mm, and that damage of the thermosensitive paper due to defective cutting was not encountered.

In the present invention, the pair of driven rotary members, holding the guide track member therebetween, are mounted on the carriage supporting the rotary blades, defective cutting due to a clearance of the carriage can be reduced, and besides straight cutting can be more positively effected. Therefore, the sheet cutter, using the carriage of the present invention, is quite advantageous in enhancing the precision of cutting of a paper sheet in a printer, a facsimile machine or the like.

What is claimed is:

1. A cutting carriage for sheet cutting adapted to be guided by a guide track member extending in a direction of a cutting width, said carriage comprising:

a pair of rotary blades for cutting a sheet; and a pair of radially opposed driven rotary members held respectively against obverse and reverse surfaces of said guide track member, said pair of driven rotary members being rotated in accordance with movement of said carriage along said guide track member;

wherein one of said driven rotary members presses against a portion of said obverse surface, the other of said driven rotary members presses against a portion of said reverse surface, and said portion of said obverse surface opposes said portion of said reverse surface; and wherein said pair of rotary blades are held in press-contact with each other at a toe-in angle, and said pair of rotary blades are connected coaxially to said pair of driven rotary members, respectively, and said pair of rotary blades are rotated respectively by said pair of driven rotary members when said pair of driven rotary members are rotated.

2. A cutting carriage according to claim 1, wherein one of said pair if driven rotary members is held to contact with the sheet at a toe-in angle, and to hold said sheet against said guide track member.

3. A cutting carriage according to claim 1, wherein said pair of driven rotary members have different outer diameters, respectively.

4. A sheet cutter comprising:

a guide track member having a flat surface portion extending in a direction of a cutting width;

a carriage comprising (i) a pair of rotary blades for cutting a sheet; and (ii) a pair of radially opposed driven rotary members held respectively against obverse and reverse surfaces of said guide track member, said pair of driven rotary members being rotated in accordance with the movement of said carriage along said guide track member; and moving means for moving said carriage;

wherein one of said driven rotary members presses against a portion of said obverse surface, the other of said driven rotary members presses against a portion of said reverse surface, and said portion of said obverse surface opposes said portion of said reverse surface; and wherein said pair of rotary blades are held in press-contact with each other at a toe-in angle, and said pair of rotary blades are connected coaxially to said pair of driven rotary members, respectively, and said pair of rotary blades are rotated respectively by said pair of driven rotary members when said pair of driven rotary members are rotated.

5. A sheet cutter according to claim 4, wherein the obverse surface of said guide track member serves as a surface for supporting the sheet thereon, and also serves as a travel surface for one of said pair of driven rotary members, and said sheet is held between said flat surface portion of said guide track member and said one driven rotary member during the movement of said carriage.

6. A sheet cutter according to claim 4, wherein said moving means is provided on a same side of said guide track member as said reverse surface.

7. A sheet cutter according to claim 4, wherein said pair of driven rotary members have different outer diameters, respectively.

8. A sheet cutter according to claim 4, wherein one of said pair of driven rotary members is held to contact with the sheet at a toe-in angle, and to hold said sheet against said guide track member.

* * * * *